US007513296B1

(12) United States Patent
Yu et al.

(10) Patent No.: US 7,513,296 B1
(45) Date of Patent: Apr. 7, 2009

(54) CLUSTERED INVESTMENT-CASTING SHELLS FOR CASTING THIN-WALLED GOLF CLUB-HEADS OF TITANIUM ALLOY

(75) Inventors: Joseph Yu, Kaohsiung (TW); Bing-Ling Chao, San Diego, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 143 days.

(21) Appl. No.: 11/648,013

(22) Filed: Dec. 28, 2006

(51) Int. Cl.
*B22C 9/04* (2006.01)

(52) U.S. Cl. ..... 164/361; 164/35; 164/516

(58) Field of Classification Search ..... 164/35, 164/516–519, 361
See application file for complete search history.

(56) References Cited

U.S. PATENT DOCUMENTS

2005/0239575 A1* 10/2005 Chao et al. ..... 473/342

OTHER PUBLICATIONS

U.S. Appl. No. 11/528,989, filed Sep. 27, 2006, Bing-Ling Chao, et al.

* cited by examiner

*Primary Examiner*—Kuang Lin
(74) *Attorney, Agent, or Firm*—Klarquist Sparkman, LLP

(57) ABSTRACT

Investment-casting shells are disclosed that have at least one cluster of individual club-head casting molds for casting thin-walled, titanium alloy club-heads at high process yield and low material usage. The shells have respective combinations of cluster configuration and number, gating, and runners, as determined systematically. Some shell configurations include a cluster of at least ten casting molds for respective club-heads each (a) having a head-volume greater than 400 $cm^3$, (b) defining at least one club-head wall having a thickness of less than 0.8 mm, and (c) defining at least one respective gate. The cluster is configured to produce a cast-ptoduct yield of greater than 80% at a material usage of less than 600 g, including process losses, per cast club-head. Also, at least one runner connects the gates together.

43 Claims, 8 Drawing Sheets

| | Caster 1 | Caster 2 | Caster 3 | Caster 4 | Caster 5 | Caster 6 |
|---|---|---|---|---|---|---|
| Degree of Complexity of Cluster#1 | 1 | 3 | 2 | 2 | 2 | 5 |
| R max (m) | 0.15 | 0.38 | 0.42 | 0.42 | 0.42 | 0.4 |
| R min (m) | NA | 0.28 | 0.24 | 0.24 | 0.24 | 0.27 |
| Major runner cross section | 21 mm, 23mm | 22 mm, 30mm | 22 mm, 22mm | 28 mm | 33 mm, 33mm | 20 mm, 45mm |
| Main gate cross section | 22 mm, 21mm | 23 mm, 20mm | 23 mm, 20mm | 23 mm, 20mm | 23 mm, 20mm | 22 mm, 30mm |
| Runner cross sectional area ($m^2$) | 0.000483 | 0.00066 | 0.000209 | 0.000616 | 0.000471 | 0.0009 |
| Wet perimeter (m) | 0.088 | 0.104 | 0.066 | 0.087962 | 0.099000 | 0.13 |
| Gate cross sectional area ($m^2$)#2 | 0.000462 | 0.00092 | 0.00092 | 0.00092 | 0.00092 | 0.00132 |
| Interface gating ratio (%) Runner-to-Gate#3 | 104.55% | 71.74% | 22.72% | 66.93% | 51.24% | 68.18% |
| R (flow radius) of runner (m) | 0.0054 | 0.0063 | 0.0032 | 0.0070 | 0.0048 | 0.0069 |
| Sharp Turn | 1 | 2 | 2 | 2 | 2 | 3 |
| Rotation (rpm) | 505 | 370 | 380 | 380 | 380 | 340 |
| Shell Preheat Temp. (°C) | 900 | 750 | 750 | 750 | 750 | 500 |
| Angular Speed ω (rad/sec) | 52.88 | 38.75 | 39.79 | 39.79 | 39.79 | 35.60 |
| Pouring material (kg) | 9.3 | 39.2 | 35 | 32 | 32 | 72.2 |
| Casting pieces | 14 | 48 | 48 | 48 | 48 | 96 |
| Process loss (kg) | 3.9 | 6 | 7.5 | 7.5 | 7.5 | 10 |

FIG. 4

| | | | | | | |
|---|---|---|---|---|---|---|
| Actual available filling material (kg) | 5.4 | 33.2 | 27.5 | 24.5 | 24.5 | 62.2 |
| Material usage (kg/pc) (w/o process loss) | 0.664 | 0.817 | 0.729 | 0.667 | 0.667 | 0.752 |
| Material usage (kg/pc) (w/ process loss) | 0.386 | 0.692 | 0.573 | 0.510 | 0.510 | 0.648 |
| Process loss ratio | 41.9% | 15.3% | 21.4% | 23.4% | 23.4% | 13.9% |
| Velocity max (m/s) | 7.93 | 14.72 | 16.71 | 16.71 | 16.71 | 14.24 |
| Velocity min (m/s) | NA | 10.85 | 9.55 | 9.55 | 9.55 | 9.61 |
| Acceleration max ($m/s^2$) | 419.47 | 570.45 | 665.04 | 665.04 | 665.04 | 507.05 |
| Acceleration min ($m/s^2$) | NA | 420.33 | 380.02 | 380.02 | 380.02 | 342.26 |
| Force max (Nt) | 161.80 | 394.56 | 381.01 | 339.45 | 339.45 | 328.53 |
| Force min (Nt) | NA | 290.73 | 217.72 | 193.97 | 193.97 | 221.75 |
| Pressure max (Pa) | 334984.13 | 597821.56 | 1823027.72 | 551289.62 | 720076.71 | 365027.92 |
| Pressure min (Pa) | NA | 316010.94 | 236653.91 | 210837.12 | 210837.12 | 167995.81 |
| Kinetic energy max (J) | 12.13 | 74.97 | 80.01 | 71.28 | 71.28 | 65.71 |
| Density (MP) ($g/cm^3$) | 4.11 | 4.11 | 4.11 | 4.11 | 4.11 | 4.11 |
| Viscosity (MP) (g/cm*sec) | 0.033 | 0.033 | 0.033 | 0.033 | 0.033 | 0.033 |
| Re number max | 212075.72 | 465478.47 | 263656.77 | 582820.22 | 396456.52 | 491181.21 |
| Re number min) | NA | 342984.14 | 150661.01 | 333040.13 | 226546.58 | 331547.32 |
| **Casting Yield** | **94%** | **93%** | **78%** | **94%** | **94%** | **89%** |

FIG. 4 (cont'd)

CLUSTERED INVESTMENT-CASTING SHELLS FOR CASTING THIN-WALLED GOLF CLUB-HEADS OF TITANIUM ALLOY

FIELD

This disclosure pertains to golf clubs and club-heads for golf clubs. More specifically, the disclosure is directed to metal club-heads and to investment casting of metal club-heads and components of them.

BACKGROUND

With the ever-increasing popularity and competitiveness of golf, substantial effort and resources are currently being expended to improve golf clubs so that increasingly more golfers can have more enjoyment and more success at playing golf. Much of this improvement activity has been in the realms of sophisticated materials and club-head engineering. For example, modern "wood-type" golf clubs (notably, "drivers" and "utility clubs"), with their sophisticated shafts and non-wooden club-heads, bear little resemblance to the "wood" drivers, low-loft long-irons, and higher numbered fairway woods used years ago. These modem wood-type clubs are generally called "metal-woods."

An exemplary metal-wood golf club such as a fairway wood or driver typically includes a hollow shaft having a lower end to which the club-head is attached. Most modem versions of these club-heads are made, at least in part, of a light-weight but strong metal such as titanium alloy. The club-head comprises a body to which a strike plate (also called a face plate) is attached or integrally formed. The strike plate defines a front surface or strike face that actually contacts the golf ball.

The current ability to fashion metal-wood club-heads of strong, light-weight metals and other materials has allowed the club-heads to be made hollow. Use of light-weight materials has also allowed club-head walls to be made thinner, which has allowed increases in club-head size, compared to earlier club-heads. Larger club-heads tend to provide a larger "sweet spot" on the strike plate and to have higher club-head inertia, thereby making the club-heads more "forgiving" than smaller club-heads.

The distribution of mass around the club-head typically is quantified by parameters such as rotational moment of inertia (MOI) and CG. Club-heads typically have multiple rotational MOIs, each associated with a respective Cartesian reference axis (x,y,z) of the club-head. A rotational MOI is a measure of the club-head's resistance to angular acceleration (twisting or rotation) about the respective reference axis. The rotational MOIs are related to, inter alia, the distribution of mass in the club-head with respect to the respective reference axes. Each of the rotational MOIs desirably is maximized as much as practicable to provide the club-head with more forgiveness.

Regarding the total mass of the club-head as the club-head's mass budget, at least some of the mass budget must be dedicated to providing adequate strength and structural support for the club-head. This is termed "structural" mass. Any mass remaining in the budget is called "discretionary" or "performance" mass, which can be distributed within the club-head to address performance issues, for example.

As noted above, an important strategy for obtaining more discretionary mass is to reduce the wall thickness of the club-head. For a typical titanium-alloy "metal-wood" club-head having a volume of 460 $cm^3$ (i.e., a driver) and a crown area of 100 $cm^2$, the thickness of the crown is typically about 0.8 mm, and the mass of the crown is about 36 g. Thus, reducing the wall thickness by 0.2 mm (e.g., from 1 mm to 0.8 mm) can yield a discretionary mass "savings" of 9.0 g.

Modern hollow metal club-heads, particularly of the "metal-wood" type, are made by investment casting, which is the best known method for forming the intricate surficial and interior details of the club-head at a practical cost. In investment casting, reducing club-head wall thickness, however, is not easily achieved. Forming a thinner wall requires a correspondingly narrower mold cavity to which greater force must be applied to urge molten metal fully and completely into the cavity. Also, narrower mold cavities and higher pressures increase the probability that the metal will flow turbulently into the cavities, wherein turbulent flow tends to generate casting defects. Other engineering challenges include achieving the desired strength and surface requirement of the cast part, achieving the desired combination of high yield and low material usage (two conflicting requirements), and using revert to further reduce costs.

SUMMARY

This disclosure addresses these challenges and discloses investment-casting shells comprising at least one cluster of individual club-head casting molds for casting thin-walled, titanium alloy club-heads at high process yield and low material usage. To such ends, the subject investment-casting shells have particular combinations of cluster configuration and number, gating, and runners, as determined systematically. The shells desirably are used under optimal casting parameters.

According to a first aspect, investment-casting shells are provided for use in investment casting of golf club-heads of a titanium alloy. An embodiment of such an investment-casting shell comprises a cluster of at least ten casting molds for respective club-heads each (a) having a head-volume greater than 400 $cm^3$, (b) defining at least one club-head wall having a thickness of less than 0.8 mm, and (c) defining at least one respective gate. The cluster is configured to produce a cast-product yield of greater than 80% at a material usage of less than 600 g, including process losses, per cast club-head. Also, at least one runner connects the gates together.

Each casting mold desirably defines a respective main gate and at least one respective assistant gate connected to the respective main gate. In some examples the gates and at least one runner desirably have an interface gating ratio ranging from 0.7 to 1.3. In other examples the interface gating ratio ranges from 0.8 to 1.2, and in yet other examples from 0.9 to 1.1.

In some embodiments, at the casting molds, the respective gates have respective runner-gate interfaces at the at least one respective runner, wherein the runner-gate interfaces is configured to provide a fluid flow having a Reynolds number $Re \leqq 6.0\times10^5$. In other examples the runner-gate interfaces each have a Reynolds number $Re \leqq 4.5\times10^5$. In yet other examples the runner-gate interfaces each have a Reynolds number $Re \leqq 3.0\times10^5$, or $Re \leqq 2.0\times10^5$.

In some embodiments the gates have respective runner-gate interfaces at the at least one runner. The runner-gate interfaces desirably are configured to require, during use of the shell for casting titanium-alloy club-heads, a minimum force $\leqq$350 Nt. In other examples the runner-gate interfaces are configured to a minimum force $\leqq$250 Nt, more desirably $\leqq$150 Nt.

The at least one runner can have any of various cross-sectional profiles such as, but not limited to, a triangular cross-section. Also, the at least one runner has less than three turns of 90° or greater. In some embodiments a receptor is connected to the at least one runner.

According to another aspect, methods are provided for casting titanium-alloy club-heads for golf clubs. An embodiment of such a method comprises preparing an investment-casting shell comprising at least one cluster of at least ten casting molds for casting respective club-heads each having (a) a head-volume greater than 400 $cm^3$, (b) at least one wall having a thickness of less than 0.8 mm, and (c) at least one respective gate. The investment-casting shell is prepared with a configuration suitable for producing a cast-product yield of greater than 80% at a material usage of less than 600 g, including process losses, per casting mold. The cluster also is prepared so as to comprise at least one runner connecting together the gates. At a preset force, molten titanium alloy is introduced into the investment-casting shell and into the at least one cluster. The molten titanium alloy is flowed in the at least one runner through the gates and into the individual casting molds to fill the casting molds with titanium alloy and thus cast the respective club-heads. This method further can comprise rotating the investment-casting shell in a subatmospheric pressure to produce the preset force. For example, not intending to be limiting, the investment-casting shell is rotated at least 300 rpm.

The method further can comprise preheating the investment-casting shell before introducing the molten titanium alloy into the investment-casting shell. By way of example, not intending to be limiting, the investment-casting shell is preheated to a temperature of at least 500° C.

The investment-casting shell can be prepared such that the gates and at least one runner have an interface gating ratio ranging from 0.7 to 1.3. In other embodiments the investment-casting shell is prepared such that the gates and at least one runner have an interface gating ratio ranging from 0.8 to 1.2, or an interface gating ratio ranging from 0.9 to 1.1.

The investment-casting shell can be prepared such that the gates have respective runner-gate interfaces at the at least one runner, and the runner-gate interfaces each have a Reynolds number $Re \leqq 6.0 \times 10^5$, for example. In other examples the runner-gate interfaces each have a Reynolds number $Re \leqq 4.5 \times 10^5$. In yet other examples the runner-gate interfaces each have a Reynolds number $Re \leqq 3.0 \times 10^5$, or $Re \leqq 2.0 \times 10^5$.

The gates can be prepared to have respective runner-gate interfaces at the at least one runner, wherein the titanium alloy is introduced into the cluster at a minimum force that is no greater than 350 Nt, for example. In other examples, the titanium alloy is introduced into the cluster at a minimum force that is no greater than 250 Nt, and in yet other examples at a minimum force that is no greater than 150 Nt.

As noted, the runner can be configured with any of various cross-sectional profiles such as, but not limited to, triangular. Also, the at least one runner desirably has less than three turns of 90° or greater.

Other embodiments of investment-casting shells for investment casting of golf club-heads of titanium alloy comprise a cluster of at least four casting molds for respective club-heads each having a head-volume greater than 400 $cm^3$ and defining a least one club-head wall of thickness less than 0.8 mm. The cluster is configured to produce a cast-product yield of greater than 80% at a material usage of less than 500 g, including process losses, per cast club-head. Desirably, each casting mold defines at least a respective main gate through which molten titanium alloy is introduced into the casting mold. The shell further can comprise at least one runner connecting together the gates.

In some examples, the gates and at least one runner have an interface gating ratio ranging from 0.7 to 1.3. In other examples, the gates and at least one runner have an interface gating ratio ranging from 0.8 to 1.2, and in yet other examples an interface gating ratio ranging from 0.9 to 1.1.

At the casting molds, the respective gates desirably have respective runner-gate interfaces at the at least one respective runner. In some examples the runner-gate interfaces each have a Reynolds number $Re \leqq 6.0 \times 10^5$. In other examples, the runner-gate interfaces each have a Reynolds number $Re \leqq 4.5 \times 10^5$, in yet other examples a Reynolds number $Re \leqq 3.0 \times 10^5$, and in yet other examples a Reynolds number $Re \leqq 2.0 \times 10^5$.

In some embodiments the gates have respective runner-gate interfaces at the at least one runner. In some examples the runner-gate interfaces each require, during use of the shell for casting titanium-alloy club-heads, a minimum force $\leqq 350$ Nt. In other examples the runner-gate interfaces each require, during use of the shell for casting titanium-alloy club-heads, a minimum force $\leqq 250$ Nt, and in yet other examples a minimum force $\leqq 150$ Nt.

As noted, the at least one runner has a triangular or other suitable cross-section. The at least one runner desirably has less than three turns of 90° or greater.

Another embodiment of a method for casting titanium-alloy club-heads for golf clubs comprises preparing an investment-casting shell comprising a cluster of at least four casting molds for respective club-heads each having (a) a head-volume greater than 400 $cm^3$ and (b) defining at least one club-head wall of thickness less than 0.8 mm. The cluster desirably is configured to produce a cast-product yield of greater than 80% at a material usage of less than 500 g, including process losses, per casting mold. At a preset force, molten titanium alloy is introduced into the investment-casting shell. Molten titanium alloy is flowed into the individual casting molds to fill the casting molds with titanium alloy and thus cast the respective club-heads.

The foregoing and additional features and advantages of the invention will be more readily apparent from the following detailed description, which proceeds with reference to the accompanying drawings.

BRIEF DESCRIPTION OF THE DRAWINGS

FIG. 4 is a table of casting data obtained from six different casters.

DETAILED DESCRIPTION

This disclosure is set forth in the context of representative embodiments that are not intended to be limiting in any way.

In the following description, certain terms may be used such as "up," "down,", "upper," "lower," "horizontal," "vertical," "left," "right," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object.

General Features of an Exemplary Metal-Wood Club-Head

Figure 1:
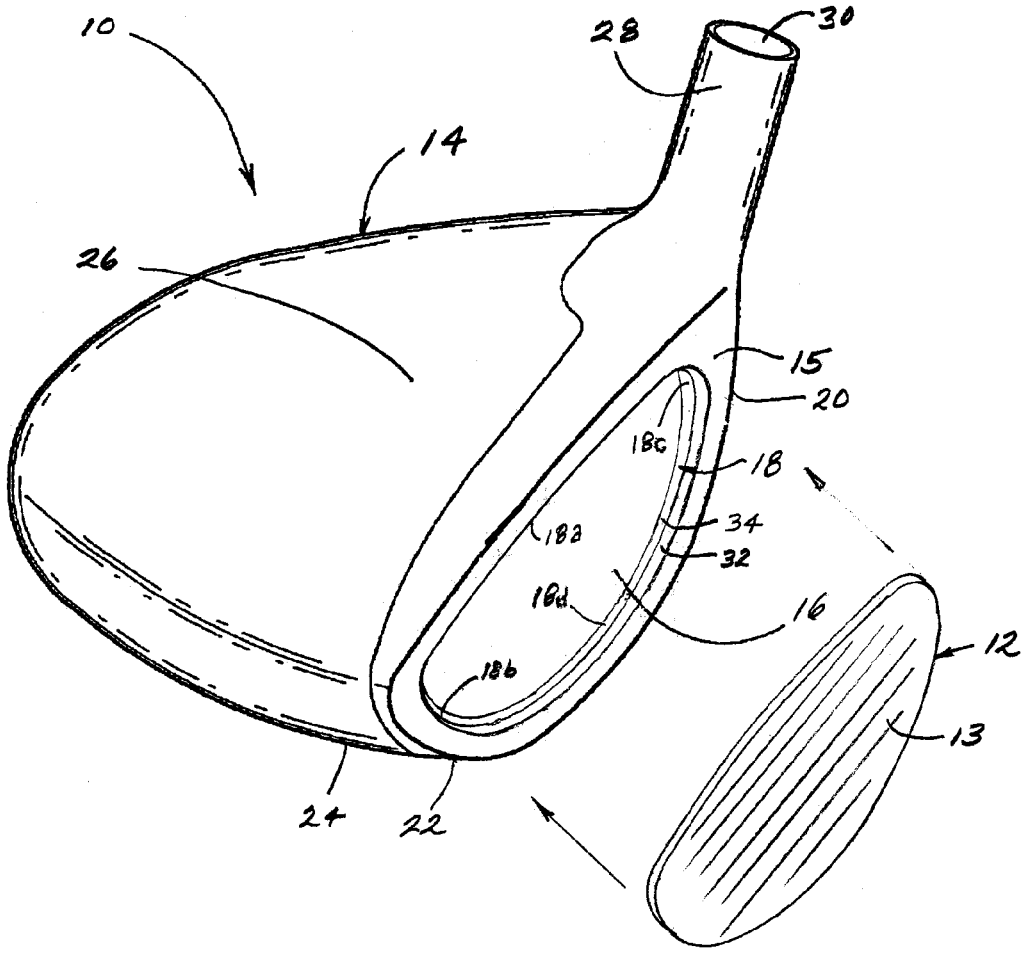
FIG. 1 is a perspective view of a "metal-wood" club-head, showing certain general features pertinent to the instant disclosure.

The main features of an exemplary metal-wood club-head 10 are depicted in FIG. 1. The club-head 10 comprises a face plate 12 and a body 14. The face plate 12 typically is convex, and has an external ("striking") surface (face) 13. The body 14 defines a front opening 16. A face support 18 is disposed about the front opening 16. The body 14 also has a heel 20, a toe 22, a sole 24, a top or crown 26, and a hosel 28. Around the front opening 16 is a "transition zone" 15 that extends along the respective forward edges of the heel 20, the toe 22, the sole 24, and the crown 26. The transition zone 15 effectively is a transition from the body 14 to the face plate 12. The hosel 28 defines an opening 30 that receives a distal end of a shaft (not shown). The opening 16 receives the face plate 12, which rests upon and is bonded to the face support 18 and transition zone 15, thereby enclosing the front opening 16. The transition zone 15 includes a sole-lip region 18*d*, a crown-lip region 18*a*, a heel-lip region 18*c*, and a toe-lip region 18*b*.

General Aspects of Investment Casting

Injection molding is used to form sacrificial "initial" patterns (made of casting "wax") of the desired castings. A suitable injection die can be made of aluminum or other suitable alloy or other material by a computer-controlled machining process using a casting master. CNC (computer numerical control) machining desirably is used to form the intricacies of the mold cavity in the die. The cavity dimensions are established so as to compensate for linear and volumetric shrinkage of the casting wax encountered during casting of the initial pattern and also to compensate for any similar shrinkage phenomena expected to be encountered during actual metal casting performed later using an investment-casting "shell" formed from the initial pattern.

Usually, a group of initial patterns is assembled together and attached to a central wax sprue to form a casting "cluster." Each initial pattern in the cluster forms a respective mold cavity in the casting shell formed later around the cluster. The central wax sprue defines the locations and configurations of runner channels and gates for routing molten metal, introduced into the sprue, to the mold cavities in the casting shell. The runner channels can include one or more filters (made, e.g., of ceramic) for enhancing smooth laminar flow of molten metal into and in the casting shell and for preventing entry of any dross, that may be trapped in the mold, into the shell cavities.

The casting shell is constructed by immersing the casting cluster into a liquid ceramic slurry, followed by immersion in a bed of refractory particles. This immersion sequence is repeated as required to build up a sufficient wall thickness of ceramic material around the casting cluster, thereby forming an investment-casting shell. An exemplary immersion sequence includes six dips of the casting cluster in liquid ceramic slurry and five dips in the bed of refractory particles, yielding an investment-casting shell comprising alternating layers of ceramic and refractory material. The first two layers of refractory material desirably comprise fine (300 mesh) zirconium oxide particles, and the third to fifth layers of refractory material can comprise coarser (200 mesh to 35 mesh) aluminum oxide particles. Each layer is dried under controlled temperature (25±5° C.) and relative humidity (50±5%) before applying the subsequent layer.

The investment-casting shell is placed in a sealed steam autoclave in which the pressure is rapidly increased to 7-10 $kg/cm^2$. Under such a condition, the wax in the shell is melted out using injected steam. The shell is then baked in an oven in which the temperature is ramped up to 1000-1300° C. to remove residual wax and to increase the strength of the shell. The shell is now ready for use in investment casting.

Investment Casting as Applied to Club-heads Made of Titanium Alloy

After the club-head is designed and the initial pattern is made, the manufacturing effort is shifted to a titanium caster. To make the investment-casting shell, the titanium caster first configures the cluster comprising multiple initial patterns for individual club-heads. Configuring the cluster also involves configuring the metal-delivery system (gates and runners for later delivery of molten metal). After completing these tasks, the caster tools up to fabricate the casting shells.

Figure 2:
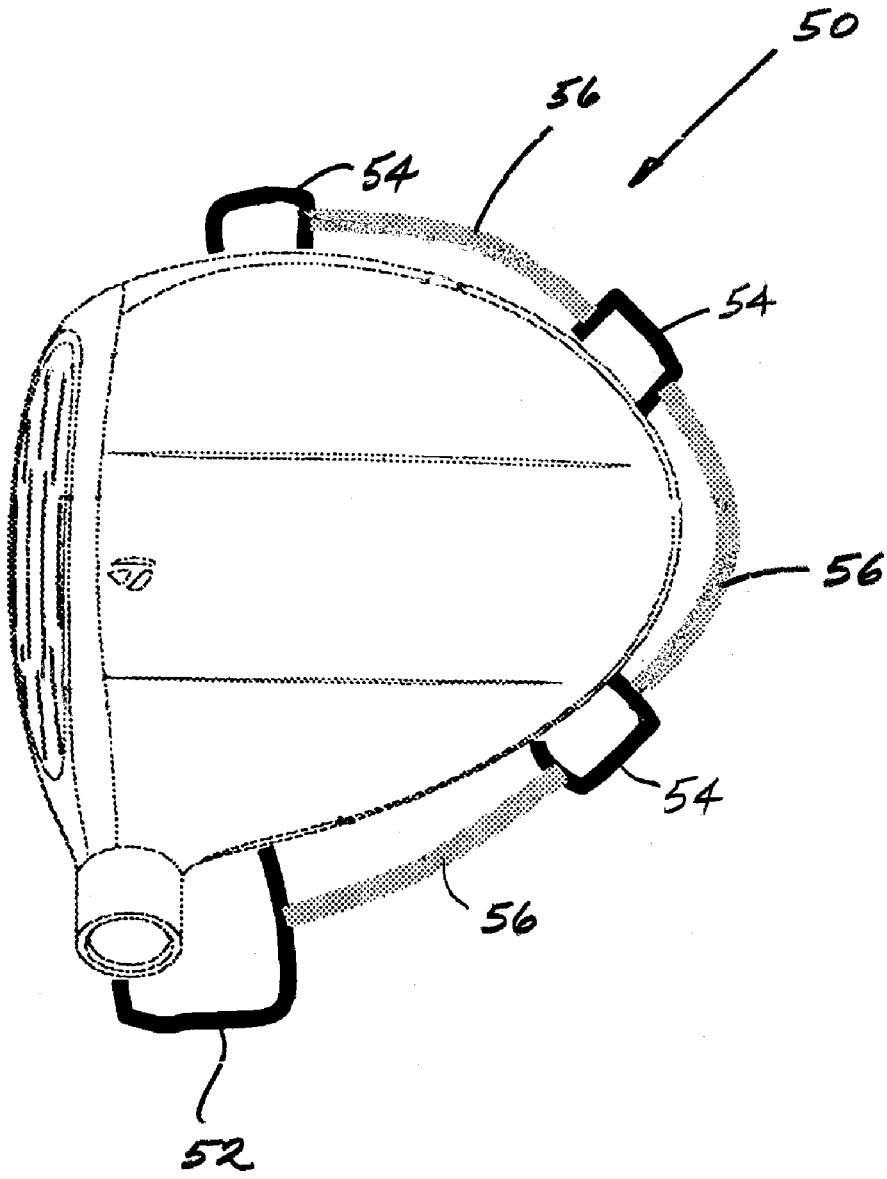
FIG. 2 is a top view of an exemplary initial pattern for a metal-wood club-head, showing main gate, assistant gates, and flow channels.

An important aspect of configuring the cluster is determining the locations at which to place the gates. A mold cavity for an individual club-head usually has one main gate, through which molten metal flows into the mold cavity. Additional auxiliary ("assistant") gates can be connected to the main gate by flow channels. During investment casting using such a shell, the molten metal flows into each of the mold cavities through the respective main gates, through the flow channels, and through the auxiliary gates. This manner of flow requires that the mold for forming the initial pattern of a club-head also define the main gate and any assistant gates. After molding the wax initial pattern of the club-head, the initial pattern is removed from the mold, and the locations of flow channels are defined by "gluing" (using the same wax) pieces of wax between the gates. Reference is made to FIG. 2, which depicts an initial pattern 50 for a metal-wood club-head. Shown are the main gate 52 and three assistant gates 54. Flow channels 56 interconnect the assistant gates 54 and main gate 52 to one another.

Multiple initial patterns for respective club-heads are then assembled into the cluster, which includes attaching the individual main gates to "ligaments." The ligaments include the sprue and runners of the cluster. A "receptor," usually made of graphite or the like, is placed at the center of the cluster where it later will be used to receive the molten metal and direct the metal to the runners. The receptor desirably has a "funnel" configuration to aid entry-flow of molten metal. Additional braces (made of, e.g., graphite) may be added to reinforce the cluster structure.

Usually, the overall wax-cluster is sufficiently large (especially if the furnace chamber that will be used for forming the shell is large) to allow pieces of wax to be "glued" to individual branches of the cluster first, followed by ceramic coating of the individual branches separately before the branches are assembled together into the cluster. Then, after assembling together the branches, the cluster is transferred to the shell-casting chamber.

Figure 3A:
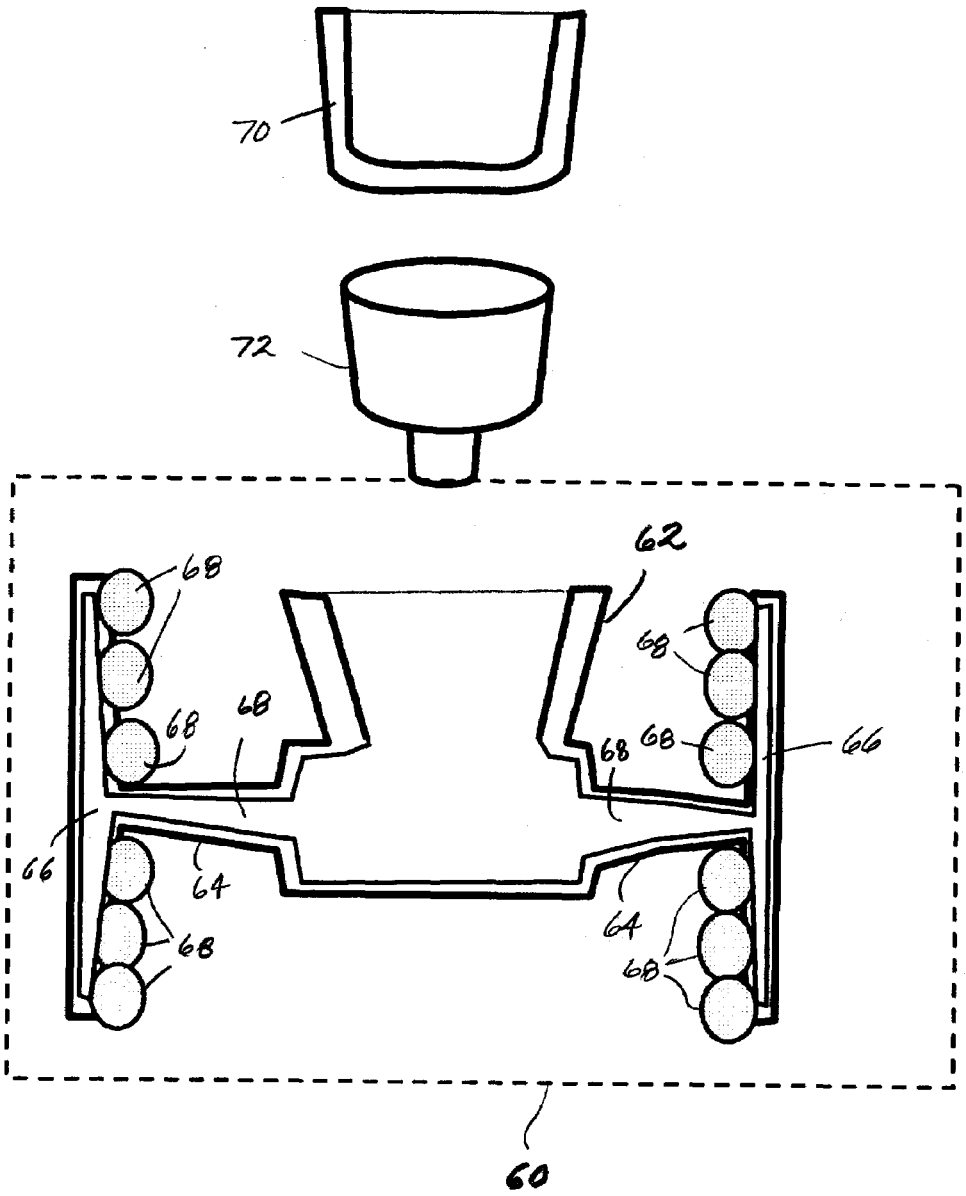
FIGS. 3(A)-3(B) schematically depict two respective casting clusters each comprising multiple mold cavities.
Figure 3B:
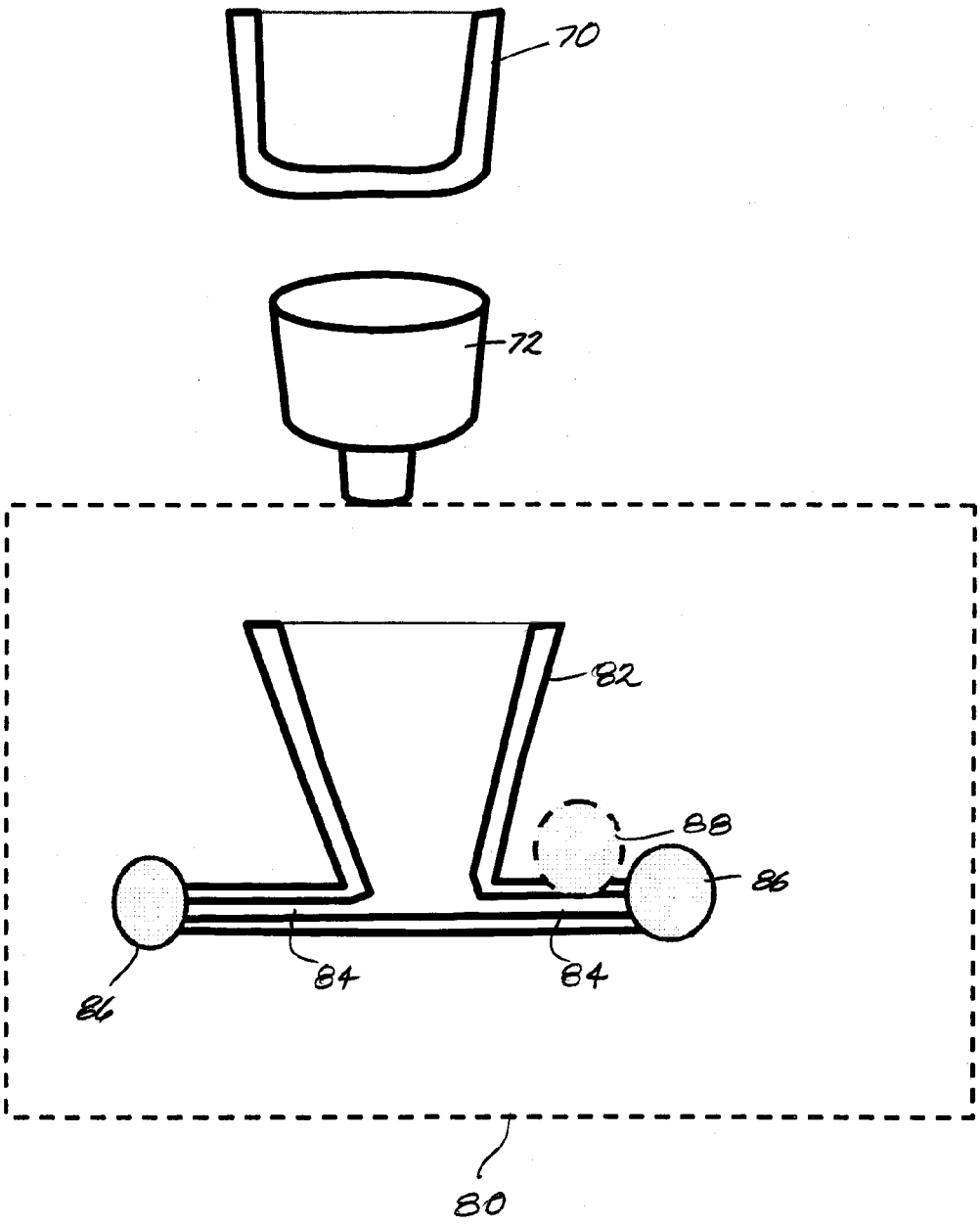

Two exemplary clusters are shown in FIGS. 3(A)-3(B), respectively. In FIG. 3(A), the depicted cluster 60 comprises a graphite receptor 62, a graphite cross-spoke 64, runners 66, and mold cavities 68. Each mold cavity 68 is for a respective club-head. Molten metal in a crucible 70 is poured into the cluster 60 using a pouring cup 72, which directs the molten metal into the receptor 62, into the branches 66, and then into the mold cavities 68. In FIG. 3(B), the depicted cluster 80 comprises a receptor 82 coupled to shell runners 84. Mold cavities are of two types in this configuration, "straight-feed" cavities 86 and "side feed" cavities 88. Molten metal in a crucible 70 is poured into the cluster 80 using a pouring cup 72, which directs the molten metal into the receptor 82, into the shell runners 84, and then into the mold cavities 86, 88.

The reinforced wax cluster is then coated with multiple layers of slurry and ceramic powders, with drying being performed between coats. After forming all the layers, the resulting investment-casting shell is autoclaved to melt the wax inside it (the ceramic and graphite portions are not melted). After removing the wax from the shell, the shell is sintered (fired), which substantially increases its mechanical strength. If the shell will be used in a relatively small metal-casting furnace (e.g., capable of holding a cluster of only one branch), the shell can now be used for investment casting. If the shell will be used in a relatively large metal-casting furnace, the shell can be assembled with other shell branches to form a large, multi-branched cluster.

Modern investment casting of titanium alloys is usually performed while rotating the casting shell in a centrifugal manner to harness and exploit the force generated by the $\omega^2 r$ acceleration of the shell undergoing such motion, where $\omega$ is the angular velocity of the shell and r is the radius of the angular motion. This rotation is performed using a turntable situated inside a casting chamber under a subatmospheric pressure. The force generated by the $\omega^2 r$ acceleration of the shell urges flow of the molten metal into the mold cavities without leaving voids. The investment-casting shell (including its constituent clusters and runners) is generally assembled outside the casting chamber and heated to a pre-set temperature before being placed as an integral unit on the turntable in the chamber. After mounting the shell to the turntable, the casting chamber is sealed and evacuated to a pre-set subatmospheric-pressure ("vacuum") level. As the chamber is being evacuated, the molten alloy for casting is prepared and the turntable commences rotating. When the molten metal is ready for pouring into the shell, the casting chamber is at the proper vacuum level, the casting shell is at a suitable temperature, and the turntable is spinning at the desired angular velocity. Thus, the molten metal is poured into the receptor of the casting shell and flows throughout the shell to fill the mold cavities in the shell.

Gating and Cluster Configurations

Configuring the gates and the cluster(s) involves consideration of multiple factors. These include (but are not necessarily limited to): (a) the dimensional limitations of the casting chamber of the metal-casting furnace, (b) handling requirements, particularly during the slurry-dipping steps that form the investment-casting shell, (c) achieving an optimal flow pattern of the molten metal in the investment-casting shell, (d) providing the cluster(s) of the investment-casting shell with at least minimum strength required for them to withstand rotational motion during metal casting, (e) achieving a balance of minimum resistance to flow of molten metal into the mold cavities (by providing the runners with sufficiently large cross-sections) versus achieving minimum waste of metal (e.g., by providing the runners with small cross-sections), and (f) achieving a mechanical balance of the cluster(s) about a central axis of the casting shell. Item (e) is important because, after casting, any metal remaining in the runners does not form product but rather is "contaminated" (a portion of which is usually recycled). These configurational factors are coupled with metal-casting parameters such as shell-preheat temperature and time, vacuum level in the metal-casting chamber, and the angular velocity of the turntable to produce actual casting results. As club-head walls are made increasingly thinner, careful selection and balance of these parameters are essential to produce adequate investment-casting results.

Details of investment casting as performed at various titanium casters tend to be proprietary. But, experiments at various casters revealed some consistencies and some general trends. For example, a particular club-head (having a volume of 460 $cm^3$, a crown thickness of 0.6 mm, and a sole thickness of 0.8 mm) was fabricated at each of six titanium casters (having respective metal-casting furnaces ranging from 10 kg to 80 kg capacity), producing the data tabulated in FIG. 4. The parameters listed in FIG. 4 include the following:

"R max" is the maximum radius of the cluster

"R min" is the minimum radius of the cluster

"Wet perimeter" is the total perimeter of the runner

"R (flow radius)" is the cross-sectional area/wet perimeter of the runner

"Sharp turn" is a 90-degree or greater turn in the runner system

"Process loss ratio" is the ratio of process loss to pouring material

"Velocity max" is the velocity at the maximum radius ($=\omega \cdot R$ max)

"Velocity min" is the velocity at the minimum radius ($=\omega \cdot R$ min)

"Acceleration max" is the acceleration at the maximum radius ($=(=\omega^2 \cdot R$ max)

"Acceleration min" is the acceleration at the minimum radius ($=\omega^2 \cdot R$ min)

"Force max" is the force at the maximum radius (=material usage (with process loss)·Acceleration max). Note that this is an approximation of the magnitude of force being applied to the molten metal at a gate. Due to each particular cluster design, the true force is almost always lower than the calculated value, with more complex clusters exhibiting greater reduction of the force.

"Force min" is the force at the minimum radius (=material usage (with process loss)·Acceleration min). Note that this is an approximation of the magnitude of force being applied to the molten metal at the gate. Due to each particular cluster design, the true force is almost always lower than the calculated value, with more complex clusters exhibiting greater reduction of the force.

"Pressure max" is the pressure of molten metal in the runner at maximum radius (=Force max/Runner cross-sectional area)

"Pressure min" is the pressure of molten metal in the runner at minimum radius (=Force min/Runner cross-sectional area)

"Kinetic energy max" is the kinetic energy of molten metal at the maximum radius (=½·material usage (w/ process loss)·velocity $max^2$)

"Density ($\rho$)" is the density of molten metal (titanium alloy) at the melting point of 1650° C. Note that most titanium casters would apply overheat by heating to above 1700° C.; however, the general trend is similar for purposes of this analysis.

"Viscosity ($\mu$)" is the viscosity of molten titanium at 1650° C. Note that most titanium casters would apply overheat by heating to above 1700° C.; however, the general trend is similar for purposes of this analysis.

"Re number max" is the Reynolds number for pipe flow at maximum radius.

This is a dimensionless number defined as:

$$\mathrm{Re} = \frac{DV_{ave}\rho}{\mu}$$

where D is pipe diameter (=4·R (flow radius)), $V_{ave}$ is average velocity of pipe flow (assumed to be identical to Velocity max), ρ is density, and μ is viscosity.

"Re number min" is defined consistently as Re number max, but at a minimum radius.

The following notes appear in FIG. 4:

#1 On a scale of 1 to 5, with "1" being a simple cluster and "5" being a very complex cluster. Complex clusters typically have numerous turns, numerous changes in cross sectional area/shape, and multiple directions of flow of molten metal as the metal flows into the mold cavities.

#2 Gate cross-sectional area for casters 2-6 is multiplied by 2 because, in the shells used by these casters, two club-head mold cavities are attached, back-to-back, at each mold-cavity location on the runner; thus, molten metal flows simultaneously into each pair of mold cavities at each such location. With caster 1, each runner feeds only one club-head mold cavity at each such location on the runner.

#3 Defined as runner cross-sectional area divided by the cross-sectional area of the main gate. Caster 1 achieved a near optimal interface gating ratio (~100%), while the other casters did not (an insufficient gating ratio for this analysis is <100%, wherein runner area<main gate area).

The following discussion resulted from the data in FIG. 4.

Minimum Force Requirement:

FIG. 4 indicates that at least a minimum force (and thus at least a minimum pressure) should be applied to the molten metal entering the casting shell for each cluster to achieve a good casting yield. The force applied to the molten metal is generated in part by the mass of actual molten metal entering the mold cavities in the cluster and by the centrifugal force produced by the rotating turntable of the casting furnace. A reduced minimum force is desirable because a lower force generally allows a reduction in the amount, per club-head, of molten metal necessary for casting. However, other factors tend to indicate increasing this force, including: thinner wall sections in the item being cast, more complex clusters (and thus more complex flow patterns of the molten metal), reduced shell-preheat temperatures (resulting in a greater loss of thermal energy from the molten metal as it flows into the investment-casting shell), and substandard shell qualities such as rough mold-cavity walls and the like. The data in FIG. 4 indicate that the minimum force required for casting a titanium-alloy club-head, of which at least a portion of the wall is 0.6 mm thick, is approximately 160 Nt. Caster 1 achieved this minimum force.

From the minimum-force requirement can be derived a lower threshold of the amount of molten metal necessary for pouring into the shell. Excluding unavoidable pouring losses, the best metal usage (as achieved by caster 1) was 386 g (0.386 kg) for club-heads each having a mass of approximately 200 g (including gate and some runner). This is equivalent to a material-usage ratio of 200/386=52 percent. The accelerations (max) applied to the investment-casting shell by the casters 2-6 were all higher than the acceleration applied by caster 1, but more molten metal was needed by each of casters 2-6 to produce respective casting yields that were equivalent to that achieved by caster 1.

Figure 5:
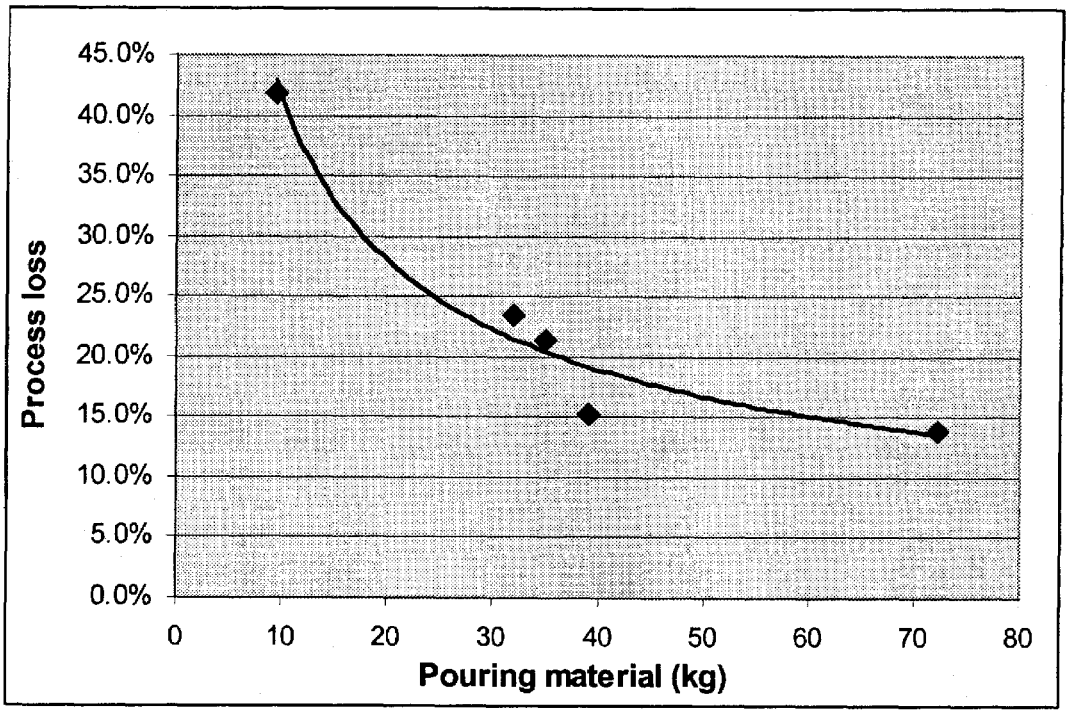
FIG. 5 is a plot of process loss versus mass of pouring material (molten metal), the latter being indicative of casting-furnace size for the various casters.

Some process loss (splashing, cooled metal adhering to side walls of the crucible and coup supplying the liquid titanium alloy, revert cleaning loss, and the like) is unavoidable. Process loss imposes an upper limit to the efficiency that can be achieved by smaller casting furnaces. I.e., the percentage of process loss increases rapidly with decreases in furnace size, as illustrated in FIG. 5.

On the other hand, smaller casting furnaces advantageously have simpler operation and maintenance requirements. Other advantages of smaller furnaces are: (a) they tend to process smaller and simpler clusters of mold cavities, (b) smaller clusters tend to have separate respective runners feeding each mold cavity, which provides better interface-gating ratios for entry of molten metal into the mold cavities, (c) the furnaces are more easily and more rapidly preheated prior to casting, (d) the furnaces offer a potentially higher achievable shell-preheat temperature, and (e) smaller clusters tend to have shorter runners, which have lower Reynolds numbers and thus pose reduced potentials for disruptive turbulent flow. While larger casting furnaces tend not to have these advantages, smaller casting furnaces tend to have more unavoidable process loss of molten metal per mold cavity than do larger furnaces.

In view of the above, the most cost-effective casting systems (furnaces, clusters, yields, net material costs) appear to be medium-sized systems, so long as appropriate cluster- and gate-design considerations are incorporated into configurations of the investment-casting shells used in such furnaces. This can be seen from comparing casters 1, 4, and 5. The overall usages of material (without considering process losses) by these three casters are very close (664-667 g/cavity). Material usage (considering process loss) by caster 1 is 386 g, while that of casters 4 and 5 is 510 g. Thus, whereas casters 4 and 5 could still improve, it appears that caster 1 has reached its limit in this regard.

Flow-Field Considerations:

At least the minimum threshold force applied to molten metal entering the investment-casting shell can be achieved by either changing the mass or increasing the velocity of the molten metal entering the shell, typically by decreasing one and increasing the other. There is a realistic limit to the degree to which the mass of "pour material" (molten metal) can be reduced. As the mass of pour material is reduced, correspondingly more acceleration is necessary to generate sufficient force to move the molten metal effectively into the investment-casting shell. But, increasing the acceleration increases the probability of creating turbulent flow (due to a high $V_{ave}$) of the molten metal entering the shell. Turbulent flow is undesirable because it disrupts the flow pattern of the molten metal. A disrupted flow pattern can require even greater force to "push" the metal though the main gate into the mold cavities.

Note that the respective Reynolds number for each caster's investment-casting shell is in the range of $2\times10^5$ to $6\times10^5$. It is unclear what the critical Reynolds number would be for a corresponding type of boundary-layer problem involving molten titanium flowing in a pipe geometry (and eventually into a plate-like mold cavity, as in an actual mold cavity for a club-head), it is nonetheless desirable that the Reynolds number be as low as possible. The data in FIG. 4 indicate that the optimal Reynolds number is approximately $2.2\times10^5$. For caster 1, this Reynolds number is equivalent to $V_{ave}$=8 m/s. For other casters, especially caster 6, a high Reynolds number indicates a high potential of turbulent flow, which offsets the advantage of high flow velocity of the molten metal (produced by the high angular velocity of the turntable). Caster 6's cluster is unnecessarily complex; some effects of a high $V_{ave}$ are offset by the complexity of the cluster.

The Reynolds number can be easily modified by changing the shape and/or dimensions of the runner(s). For example, changing R (flow radius) will affect the Reynolds number directly. The smaller R (flow radius) will result in less minimum force (the two almost having a reciprocal relationship). Hence, an advantageous consideration is first to reduce the Reynolds number to maintain a steady flow field of the molten metal, and then satisfy the requirement of minimum force by adjusting the amount of pour material.

From this analysis, smaller clusters are not the only way to obtain high yield. But, smaller clusters are more likely to produce a higher yield due mainly to their relative simplicity. It would be more difficult to fine-tune a larger cluster to reach the same level of performance that is achieved by a smaller cluster.

Other Factors:

One of these additional factors is preheating the investment-casting shell before introducing the molten metal to it. Caster 1 achieved 94% yield with the smallest Reynolds number and the minimum amount of pour material (and thus the lowest force) in part because caster 1 had the highest shell-preheat temperature. Another factor is the complexity of the cluster(s). Evaluating a complex cluster is very difficult, and the high Reynolds numbers usually exhibited by such clusters are not the only variable to be controlled to reduce disruptive turbulent flow of molten metal in such clusters. For example, the number of "sharp" turns (90-degree turns or greater) in runners and mold cavities of the cluster is also a factor. In FIG. 4 the investment-casting shell used by caster 1 has one sharp turn (and another less-sharp turn), whereas the shell used by caster 6 has three sharp turns. It is possible that caster 6 needs to rotate its shell at a higher angular velocity just to overcome the flow resistance posed by these sharp turns. But, this would not alleviate, disrupted flow patterns posed by the sharp turns. Hence, investment-casting shells comprising simpler cluster(s) (with fewer sharp turns to allow more "natural" flow routes of molten metal) are desired.

Another factor is matching the runner and gates. The interface gating ratio for caster 1 is the closest to 100% (indicating optimal gating), compared to the substantially inferior data from the other casters. The "worst" was caster 3, whose investment-casting shell had a Reynolds number almost as low as that of caster 1, but caster 3 achieved a yield of only 78%, due to a poor interface gating ratio (approximately 23%). The low interface gating ratio exhibited by the shell of caster 3 increased the difficulty of determining whether the cause of caster 3's low yield was insufficient pour material to fill the gates or the occurrence of "two-phase flow-liquid and vacancy." In any event, the overall cross-sectional areas of runners and gates should be kept as nearly equal (and constant) to each other as possible to achieve constant flow velocity of liquid metal throughout the shell at any moment during pouring. For thin-walled titanium castings, this principle applies especially to the interfaces between the runner and the main gates, where the interface gating ratio should be no less than unity (1.0).

Yet another factor is the cross-sectional shape of the runner. Comparing casters 4 and 5, and casters 2 and 5, triangular-section runners appeared to produce lower Reynolds numbers than rounded or rectangular runners. Although using triangular-section runners can cause problems with interface gating ratio (as metal flows from such a runner into a rectilinear-section or round-section gate), the significant reduction in Reynolds numbers achieved using triangular-section runners is worth pursuing as the difference in pour material used by casters 2 and 5 indicates (39 kg versus 32 kg).

Figure 6:
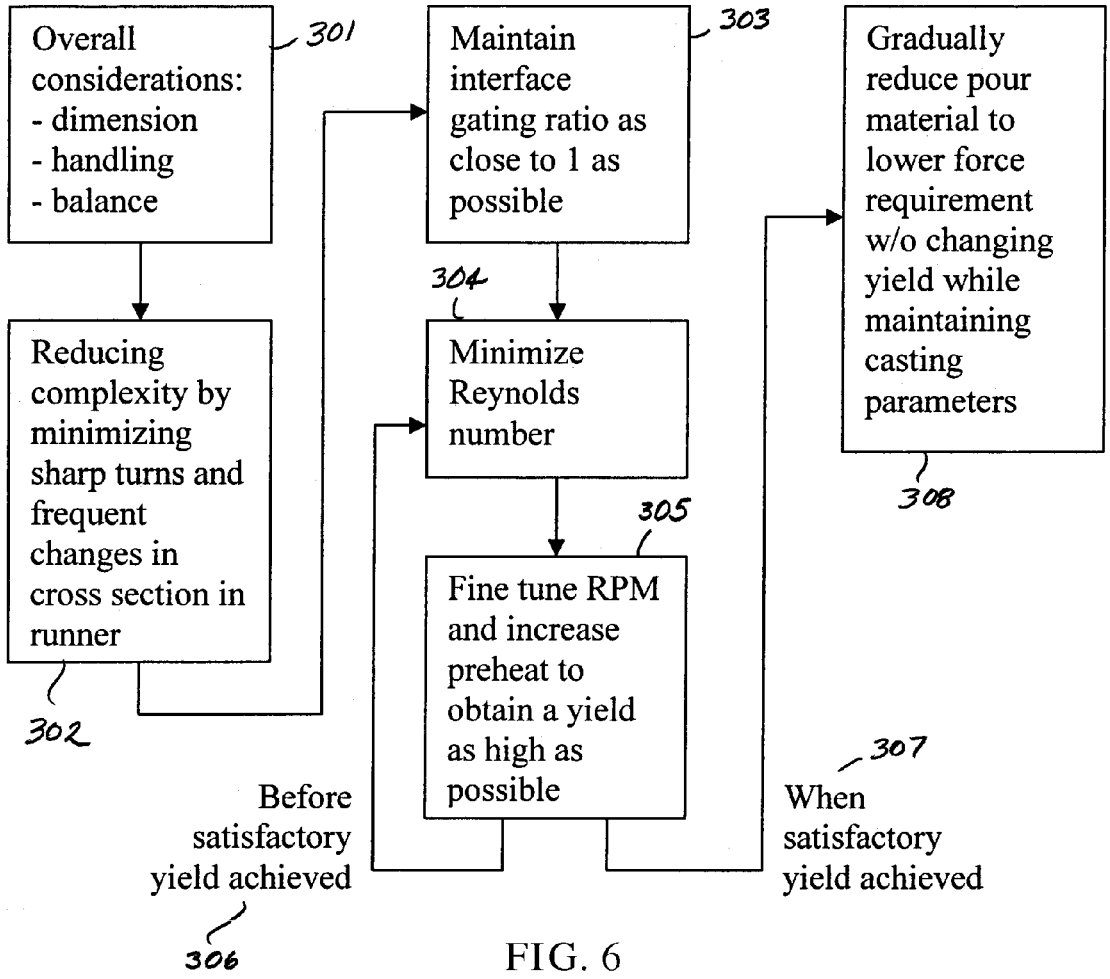
FIG. 6 is a flow chart of an embodiment of a method for configuring a casting cluster.

A flow-chart for configuring a cluster of an investment-casting shell is shown in FIG. 6. In a first step 301, overall considerations of the intended cluster are made such as dimensions, handling, and balance. Next, the complexity of the cluster is reduced by minimizing sharp turns and any unnecessary (certainly any frequent) changes in runner cross-section (step 302). The interface gating ratio is maintained as close as possible to unity (step 303). Also, the Reynolds number is minimized as much as practicable (step 304). The angular velocity (RPM) of the turntable is fine-tuned and the shell pre-heat temperature is increased to produce the highest possible product yield (step 305). Iteration (306) of steps 304, 305 is usually required to achieve a satisfactory yield. In step 308, after a satisfactory yield is achieved (307), the mass of pour material (molten metal) is gradually reduced to reduce the force required to urge flow of molten metal throughout the cluster, but without decreasing product yield and while maintaining other casting parameters.

Whereas the invention has been described in connection with representative embodiments, it is not limited to those embodiments. On the contrary, the invention is intended to encompass all modifications, alternatives, and equivalents as may be included in the spirit and scope of the invention, as defined by the appended claims.

What is claimed is:

1. An investment-casting shell for investment casting of golf club-heads of titanium alloy, the investment-casting shell comprising:

a cluster of at least ten casting molds for respective club-heads, each casting mold having a head-volume greater than 400 $cm^3$, defining at least one club-head wall having a thickness of less than 0.8 mm, and defining at least one respective gate, the cluster being configured to produce a cast-product yield of greater than 80% at a material usage of less than 600 g, including process losses, per cast club-head; and at least one runner connecting together the at least one respective gate of each mold, wherein the at least one respective gate and at least one runner have an interface gating ratio ranging from 0.7 to 1.3.

2. The investment-casting shell of claim 1, wherein the at least one respective gate includes a respective main gate and at least one respective assistant gate connected to the respective main gate.

3. The investment-casting shell of claim 1, wherein the at least one respective gate and the at least one runner have an interface gating ratio ranging from 0.8 to 1.2.

4. The investment-casting shell of claim 3, wherein the at least one respective gate and the at least one runner have an interface gating ratio ranging from 0.9 to 1.1.

5. The investment-casting shell of claim 1, wherein:

at the casting molds, the at least one respective gates includes a respective runner-gate interface at the at least one respective runner; and the runner-gate interfaces is configured to provide a fluid flow having a Reynolds number of $Re \leqq 6.0 \times 10^5$.

6. The investment-casting shell of claim 5, wherein the runner-gate interface is configured to provide a fluid flow having a Reynolds number of $Re \leqq 4.5 \times 10^5$.

7. The investment-casting shell of claim 6, wherein the runner-gate interface is configured to provide a fluid flow having a Reynolds number of $Re \leqq 3.0 \times 10^5$.

8. The investment-casting shell of claim 7, wherein the runner-gate interface is configured to provide a fluid flow having a Reynolds number of $Re \leqq 2.0 \times 10^5$.

9. The investment-casting shell of claim 1, wherein:

the at least one respective gate includes a respective runner-gate interface at the at least one runner; and the runner-gate interface is configured to have a minimum force ≦350 Nt during use of the shell for casting a titanium alloy club-head.

10. The investment-casting shell of claim 9, wherein the runner-gate interface is configured to have a minimum force ≦250 Nt during use of the shell for casting a titanium alloy club-head.

11. The investment-casting shell of claim 10, wherein the runner-gate interface is configured to have a minimum force ≦150 Nt during use of the shell for casting a titanium alloy club-head.

12. The investment-casting shell of claim 1, wherein the at least one runner has a triangular cross-section.

13. The investment-casting shell of claim 1, wherein the at least one runner has less than three turns of 90° or greater.

14. The investment-casting shell of claim 1, further comprising a receptor connected to the at least one runner.

15. A method for casting titanium-alloy club-heads for golf clubs, the method comprising:

preparing an investment-casting shell comprising at least one cluster of at least ten casting molds for casting respective club-heads, each casting mold having a head-volume greater than 400 $cm^3$, at least one wall having a thickness of less than 0.8 mm, at least one respective gate, and at least one runner connecting together the at least one respective gate of each mold, wherein the at least one respective gate and at least one runner have an interface gating ratio ranging from 0.7 to 1.3;

at a preset force, introducing molten titanium alloy into the investment-casting shell and into the at least one cluster;

flowing the molten titanium alloy in the at least one runner through the at least one respective gate and into the individual casting molds to fill the casting molds with titanium alloy and thus cast the respective club-heads; and producing a cast-product yield of greater than 80% at a material usage of less than 600 g, including process losses per casting mold.

16. The method of claim 15, further comprising rotating the investment-casting shell in a subatmospheric pressure to produce the preset force.

17. The method of claim 16, wherein the investment-casting shell is rotated at least 300 rpm.

18. The method of claim 16, further comprising preheating the investment-casting shell before introducing the molten titanium alloy into the investment-casting shell.

19. The method of claim 18, wherein the investment-casting shell is preheated to a temperature of at least 500° C.

20. The method of claim 16, wherein the investment-casting shell is prepared such that the at least one respective gateand at least one runner have an interface gating ratio ranging from 0.8 to 1.2.

21. The method of claim 20, wherein the investment-casting shell is prepared such that the at least one respective gate and at least one runner have an interface gating ratio ranging from 0.9 to 1.1.

22. The method of claim 15, wherein the investment-casting shell is prepared such that the at least one respective gate includes a respective runner-gate interface at the at least one runner, and the runner-gate interface is configured to provide a fluid flow having a Reynolds number of $Re \leqq 6.0 \times 10^5$.

23. The method of claim 22, wherein the investment-casting shell is prepared such that the runner-gate interface is configured to provide a fluid flow having a Reynolds number of $Re \leqq 4.5 \times 10^5$.

24. The method of claim 23, wherein the investment-casting shell is prepared such that the runner-gate interface is configured to provide a fluid flow having a Reynolds number of $Re \leqq 3.0 \times 10^5$.

25. The method of claim 24, wherein the investment-casting shell is prepared such that the runner-gate interface is configured to provide a fluid flow having a Reynolds number of $Re \leqq 2.0 \times 10^5$.

26. The method of claim 15, wherein:

the investment-casting shell is prepared such that the at least one respective gate includes a respective runner-gate interface at the at least one runner; and the titanium alloy is introduced into the cluster at a minimum force that is no greater than 350 Nt.

27. The method of claim 26, wherein the titanium alloy is introduced into the cluster at a minimum force that is no greater than 250 Nt.

28. The method of claim 27, wherein the titanium alloy is introduced into the cluster at a minimum force that is no greater than 150 Nt.

29. The method of claim 15, wherein the investment-casting shell is prepared such that the at least one runner has a triangular cross-section.

30. The method of claim 15, wherein the investment-casting shell is prepared such that the at least one runner has less than three turns of 90° or greater.

31. An investment-casting shell for investment casting of golf club-heads of titanium alloy, the investment-casting shell comprising a cluster of at least four casting molds for respective club-heads, each casting mold having a head-volume greater than 400 $cm^3$ and defining a least one club-head wall of thickness less than 0.8 mm, the cluster being configured to produce a cast-product yield of greater than 80% at a material usage of less than 500 g, including process losses, per cast club-head, wherein each casting mold defines at least one respective main gate through which molten titanium alloy is introduced into the casting mold, at least one runner connecting together the at least one respective main gate of each mold, wherein the at least one respective main gate and at least one runner have an interface gating ratio ranging from 0.7 to 1.3.

32. The investment-casting shell of claim 31, wherein the at least one respective main gate and at least one runner have an interface gating ratio ranging from 0.8 to 1.2.

33. The investment-casting shell of claim 32, wherein the at least one respective main gate and at least one runner have an interface gating ratio ranging from 0.9 to 1.1.

34. The investment-casting shell of claim 31, wherein:

at the casting molds, the at least one respective main gate includes a respective runner-gate interface at the at least one respective runner; and the runner-gate interface is configured to provide a fluid flow having a Reynolds number of $Re \leqq 6.0 \times 10^5$.

35. The investment-casting shell of claim 34, wherein the runner-gate interface is configured to provide a fluid flow having a Reynolds number of $Re \leqq 4.5 \times 10^5$.

36. The investment-casting shell of claim 35, wherein the runner-gate interface is configured to provide a fluid flow having a Reynolds number of $Re \leqq 3.0 \times 10^5$.

37. The investment-casting shell of claim 36, wherein the runner-gate interface is configured to provide a fluid flow having a Reynolds number of $Re \leqq 2.0 \times 10^5$.

38. The investment-casting shell of claim 31, wherein:

the at least one respective main gate includes a respective runner-gate interface at the at least one runner; and the runner-gate interface is configured to have a minimum force ≦350 Nt during use of the shell for casting a titanium alloy club-head.

39. The investment-casting shell of claim 38, wherein the runner-gate interface is configured to have a minimum force ≦250 Nt during use of the shell for casting a titanium alloy club-head.

40. The investment-casting shell of claim 39, wherein the runner-gate interface is configured to have a minimum force ≦150 Nt during use of the shell for casting a titanium alloy club-head.

41. The investment-casting shell of claim 31, wherein the at least one runner has a triangular cross-section.

42. The investment-casting shell of claim 31, wherein the at least one runner has less than three turns of 90° or greater.

43. A method for casting titanium-alloy club-heads for golf clubs, the method comprising:

preparing an investment-casting shell comprising a cluster of at least four casting molds for respective club-heads, each casting mold having a head-volume greater than 400 $cm^3$ and defining a least one club-head wall of thickness less than 0.8 mm each casting mold defines at least one respective main gate through which molten titanium alloy is introduced into the casting mold, wherein the investment-casting shell is prepared such that the at least one main gate and at least one runner have an interface gating ratio ranging from 0.7 to 1.3;

preheating the investment-casting shell to a temperature of at least 500° C.;

at a preset force, introducing molten titanium alloy into the investment-casting shell;

flowing the molten titanium alloy into the individual casting molds to fill the casting molds with titanium alloy and thus cast the respective club-heads;

rotating the investment-casting shell at a rotational speed of at least 300 rotations per minute to produce a cast-product yield of greater than 80% at a material usage of less than 500 g, including process losses per casting mold.

* * * * *